United States Patent [19]

Moser

[11] 4,145,035

[45] Mar. 20, 1979

[54] DEVICE FOR SEPARATING MULTI-LAYERED, TRANSVERSELY PERFORATED CONTINUOUS STRIPS HAVING CARBON-PAPER STRIPS LOCATED BETWEEN THE WEB LAYERS INTO INDIVIDUAL SHEETS

[75] Inventor: Erich Moser, Taufkirchen, Fed. Rep. of Germany

[73] Assignee: RENA-Büromaschinenfabrik GmbH & Co., Deisenhofen bei München, Fed. Rep. of Germany

[21] Appl. No.: 791,492

[22] Filed: Apr. 27, 1977

[30] Foreign Application Priority Data

Apr. 27, 1976 [DE] Fed. Rep. of Germany ..... 2618476

[51] Int. Cl.[2] ..... B65H 41/00

[52] U.S. Cl. ..... 270/52.5; 225/100

[58] Field of Search ..... 270/52–52.5, 270/58; 101/224, 226, 227; 225/100, 97, 99, 101

[56] References Cited

U.S. PATENT DOCUMENTS

| | | | |
|---|---|---|---|
| 2,970,784 | 2/1961 | Kessler | 225/100 |
| 3,135,446 | 6/1964 | Sargent | 225/100 |
| 3,944,206 | 3/1976 | Bower | 270/52.5 |

FOREIGN PATENT DOCUMENTS

| | | | |
|---|---|---|---|
| 706289 | 3/1965 | Canada | 270/52.5 |
| 1456648 | 11/1976 | United Kingdom | 270/52.5 |

OTHER PUBLICATIONS

IBM Technical Disclosure Bulletin, vol. 5, #4, pp. 15–16, Sep. 1962, by R. N. Eichorn & C. Holovka, Jr.

*Primary Examiner*—Edgar S. Burr
*Assistant Examiner*—A. Heinz
*Attorney, Agent, or Firm*—Blanchard, Flynn, Thiel, Boutell & Tanis

[57] ABSTRACT

A device for separating multi-layered strips of paper having carbon paper provided therebetween. The separating device cooperates with the transversely located perforations in the continuous strip to drive the continuous strip through the separating device. The continuous strip also has transversely extending serrations therein which are severed in the separating device so that the continuous strip is separated into individual sheets. Each station in the separating device has a pair of inlet rollers and a pair of outlet rollers with the outlet rollers being driven at a speed which is greater than the speed of the inlet rollers so that the continuous strip is effectively pulled so that the transversely extending serrations will become severed and the individual sheets will be collected at an outlet.

12 Claims, 5 Drawing Figures

DEVICE FOR SEPARATING MULTI-LAYERED, TRANSVERSELY PERFORATED CONTINUOUS STRIPS HAVING CARBON-PAPER STRIPS LOCATED BETWEEN THE WEB LAYERS INTO INDIVIDUAL SHEETS

FIELD OF THE INVENTION

The invention relates to a device for separating multi-layered, transversely perforated continuous strips having carbon-paper strips positioned between the strip layers into individual sheets.

BACKGROUND OF THE INVENTION

In output printers in the electronic data processing systems, so-called "continuous writing sets" are used which have perforated lateral guide edges and through-going transverse perforations after each form format. After printing, the perforated guide edges are pulled off, the layers of paper are separated and disassembled into individual sheets and the carbon paper is removed.

It is known to use separate devices for the individual operations. Thus, so-called "separating machines" exist which separate the multi-layered continuous strip set into individual sheets and remove the carbon-paper layers which lie between the sheets.

Further machines are needed for separating the separated continuous strip into individual sheets, namely so-called cutting machines or "tearers", depending on whether the form is cut or torn.

This relatively expensive machine equipment is suited only for separating the printed material after printing in large electronic data processing systems. In computer systems in small and medium-sized operations, the continuous strips are therefore mostly separated by hand.

The basic purpose of the invention is to carry out the entire process, namely separating the strip layers, separating same into individual sheets, removing the carbon paper and severing the perforated lateral guide edges in one operation within one device, whereby this device is constructed as simple and compactly as possible and is quiet in operation.

The invention attains this purpose by providing, for separating the strip in one single run, several wind-up devices which are each provided for one carbon-paper strip and several separating devices which are each provided for one paper sheet layer.

According to a development of the invention, the separating devices each consist in a conventional manner of two roller pairs, wherein the outlet roller pair has a greater peripheral speed than the inlet roller pair, the continuous paper strip layer extends inclined between the inlet and outlet roller pairs and a roof-shaped tearing edge is arranged at the bending point in the path of travel. Through this the necessary tearing forces are reduced considerably and the tearing noise is reduced. It is also possible to use structurally smaller parts for the separating device. These advantages are true for many separating devices to keep the entire device from becoming too expensive.

In order to exclude the effects of different strip speeds, according to a further development of the invention each inlet roller of the separating device and each wind-up device is driven through a slip clutch.

In order to prevent the paper pull which occurs during tearing from acting back onto the incoming continuous paper strip and the entire drive, according to a further development of the invention, each inlet roller pair has a free-wheeling device which is provided between the driving gear and the shaft of the feed roller parallel to the slip clutch, such that it blocks when during the tearing operation the paper pull accelerates the feed roller.

For simplification, all feed rollers of the separating devices and all wind-up devices are driven through a common drive. In the same manner the individual stations of the device are provided one above the other and the paper infeed to the individual stations from above downwardly, which results in a very small floor space for the machine and service is simplified.

According to a further development of the invention, the outlet roller pairs of the separating devices are arranged superposed in a frame which can be adjusted with respect to the base frame. This permits in a simple manner to be able to adjust all separating devices to the desired different form lengths.

BRIEF DESCRIPTION OF THE DRAWINGS

The invention will be described more in detail hereinafter with reference to one exemplary embodiment which is illustrated in the drawings. A whole device for quadruple writing sets is hereby illustrated. A different structure could be selected at any time.

In the drawings.

DETAILED DESCRIPTION

Figure 1:
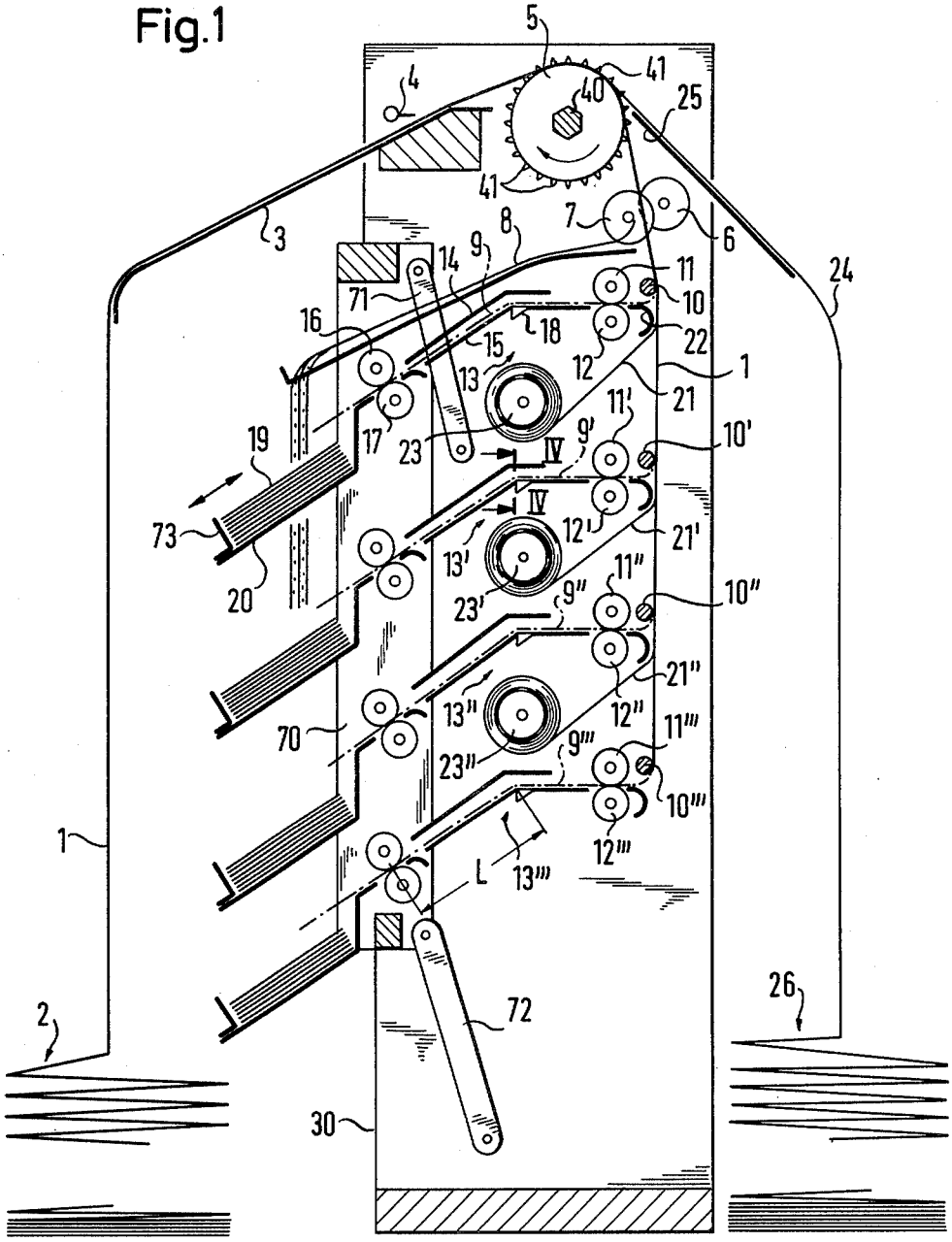
FIG. 1 is a schematic side view of the device for separating a multi-layered, transversely perforated continuous strip into individual sheets.

The multi-layered, transversely perforated continuous paper strip 1 which is to be separated is fed according to FIG. 1 from a stack 2 over the feed plate 3 passing below a braking brush 4 to laterally located, driven sprocket wheels 5 which engage perforated guide edges on a continuous paper strip to effect a pulling of the continuous paper strip 1 into the device.

The perforated guide edges 8 of the strip are cut off by two laterally located cutter pairs 6, 7. After this, the lowermost first continuous strip layer 9 is fed around the guide rod 10 to the feed roller pair 11, 12 of the uppermost form separator or strip handling device 13. The feed roller pair 11, 12 moves the continuous strip layer 9 between the guide means 14, 15 to the outlet roller pair 16, 17 which has a greater peripheral speed than the inlet feed roller pair 11, 12. This causes a tractive force to be applied onto the continuous strip layer 9, so that the paper tears at the transverse perforation thereby defining a form bursting device. This operation is favored by a so-called tear aid 18. The now-separated individual sheet 9 falls into the storage compartment 20. The form separator or strip handling device 13 will be described in more detail hereinbelow.

The carbon paper layer 21 which comes after the first continuous paper layer 9 is guided over a baffle 22 and is wound up on the spindle 23 in a conventional manner.

The second continuous paper strip layer 9' is separated in the form separator or strip handling device 13', which is designed like the already-described form separator or strip handling device 13.

The second continuous carbon paper strip 21' is, similar to the already-described one, wound up on the spindle 23'. The following paper and carbon strip layers are handled in the same manner, until the entire set is separated.

If the number of the web layers exceeds the number of the separating and winding-up devices, the extra layers 24 are deflected prior to entry into the cutters 6, 7 by a baffle 25 and are placed in a suitable device or on the ground again into a stack 26. This stack 26 can subsequently be separated during a second travel as described above.

Figure 2:
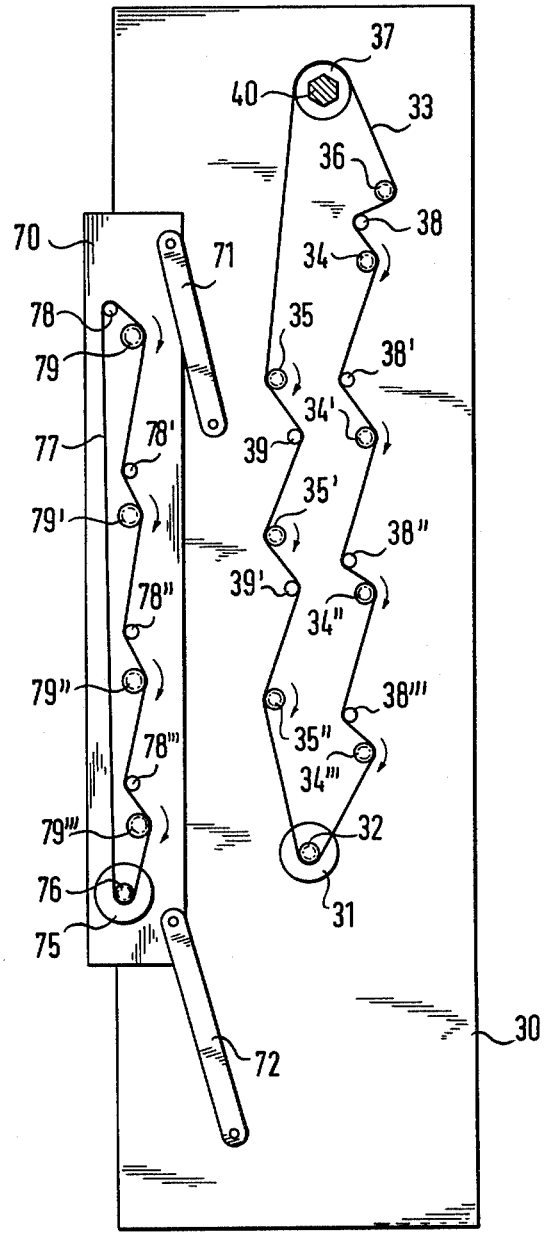
FIG. 2 is a schematic view of the drives for the individual devices.

FIG. 2 schematically illustrates the entire drive system. A toothed belt 33 is driven through the pinion 32 on the machine frame 30 by the motor 31 which is fixedly connected to the machine frame 30. The toothed belt 33 drives the gears 34 to 34''' for the feed rollers 11 to 11''', the gears 35 to 35'' for the carbon paper spindles 23 to 23'', the gear 36 for the cutters 6 and the gear 37 for the sprocket wheels 5. The intermediate gears 38 to 38''' and 39 to 39' are used to tension the tooth belt 33 and to permit a sufficiently large looping angle on the gears 34, 35 and 36. The gear 37 is fixedly connected to the hexagonal shaft 40 of the sprocket wheels 5. To adjust to the different form widths, the sprocket wheels 5 are movable with respect to one another on said hexagonal shaft 40 and can thus be adjusted to the side of the continuous paper strip. Since the sprocket wheels 5 are driven form-lockingly and, on the other hand, the sprocket teeth 41 engage form-lockingly with the perforated guide edges 8 of the continuous paper strip 1, they determine the running speed of the strip 1. The wind-up spindles 23 for the carbon papers 21 are driven in a conventional manner by the gears 35 through separate not-illustrated slip clutches, because the variable winding diameter does not permit any fixed rotational speed. Between the gears 34 and the feed rollers 11 there are also provided, as can be seen from FIG. 3, slip clutches 42 so that it is not possible due to uneven roller diameters and possibly occurring slip to permit all web layers 9 to 9''' to run synchronously with respect to one another. A freewheeling device 43 assures that the slip clutches 42 become ineffective when the feed roller 11 is speeded up during tearing by the paper strip pull.

The rotational speed of the feed roller 11 is limited by the self-limiting freewheeling device 43 to the rotational speed of the gear 34.

Figure 3:
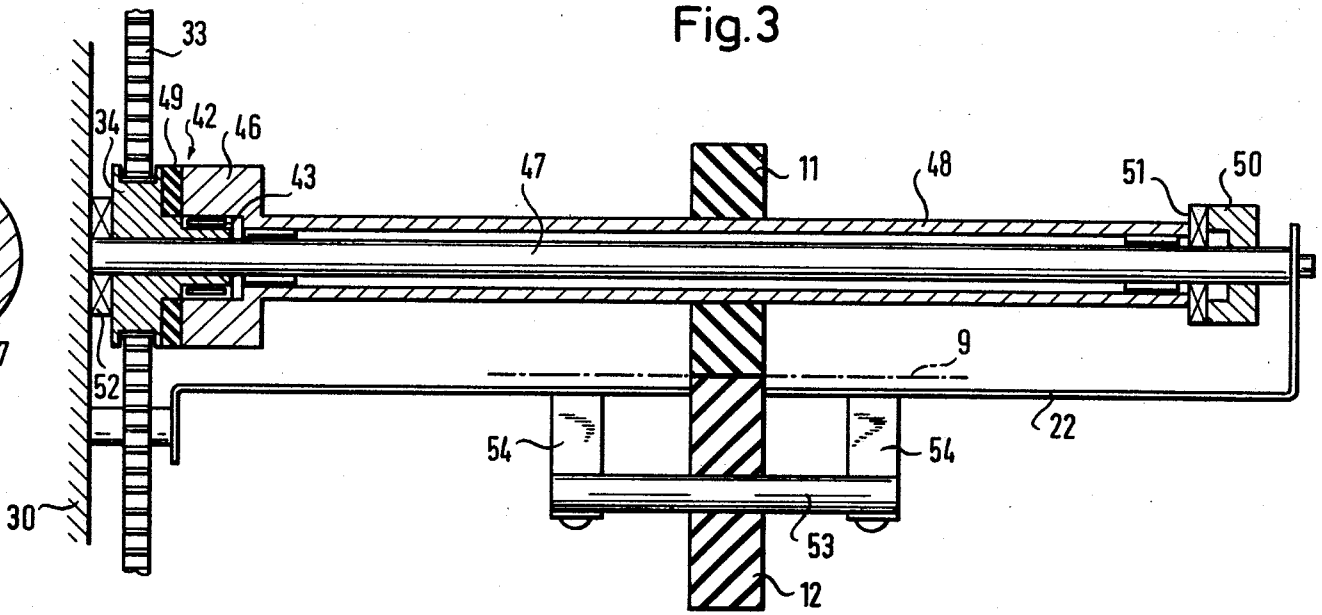
FIG. 3 is a schematic longitudinal cross-sectional view of an intake roller pair with drive.
Figure 4:
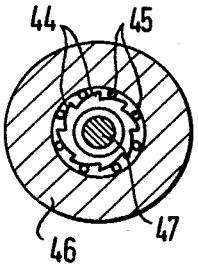
FIG. 4 is a front view of the freewheel which is used for a feed roller.

Cross-sectional views of the feed roller 11 and the freewheeling device 43 can be seen in FIGS. 3 and 4. The locking teeth 44 of the freewheeling device 43 are connected to the gear 34 which rotates in a clockwise direction. The feed roller 11 is driven through the slip clutch 42, however, moves with a smaller speed than the gear 34 due to the paper strip speed which is pregiven by the sprocket wheels 5. The clamping roller 45 of the freewheel 43 is thus free. The freewheeling device 43 goes into a locking position when the flange 46 tends to rotate faster during tearing.

The gear 34 is rotatably supported on a shaft 47 which is fixedly connected to the frame 30, also a hollow sleeve 48 on which the feed roller, which consists of an elastic material having a high friction coefficient, is secured.

A radially extending flange 46 is connected to the sleeve 48 and presses against the friction lining 49 of the slip clutch 42. The bearing pressure, which is transmitted through an axial thrust bearing 51, the sleeve 48 and the flange 46, can be adjusted at an adjusting nut 50 threadedly engaging the shaft 47. The gear 34 is supported through an axial thrust bearing 52 against the frame 30. The roller 12 is rotatably supported on the shaft 53 and is pressed by the leaf spring 54, which in turn is secured to the baffle 22 against the roller 11 in order to create the necessary bearing pressure with respect to the paper strip 9.

Figure 5:
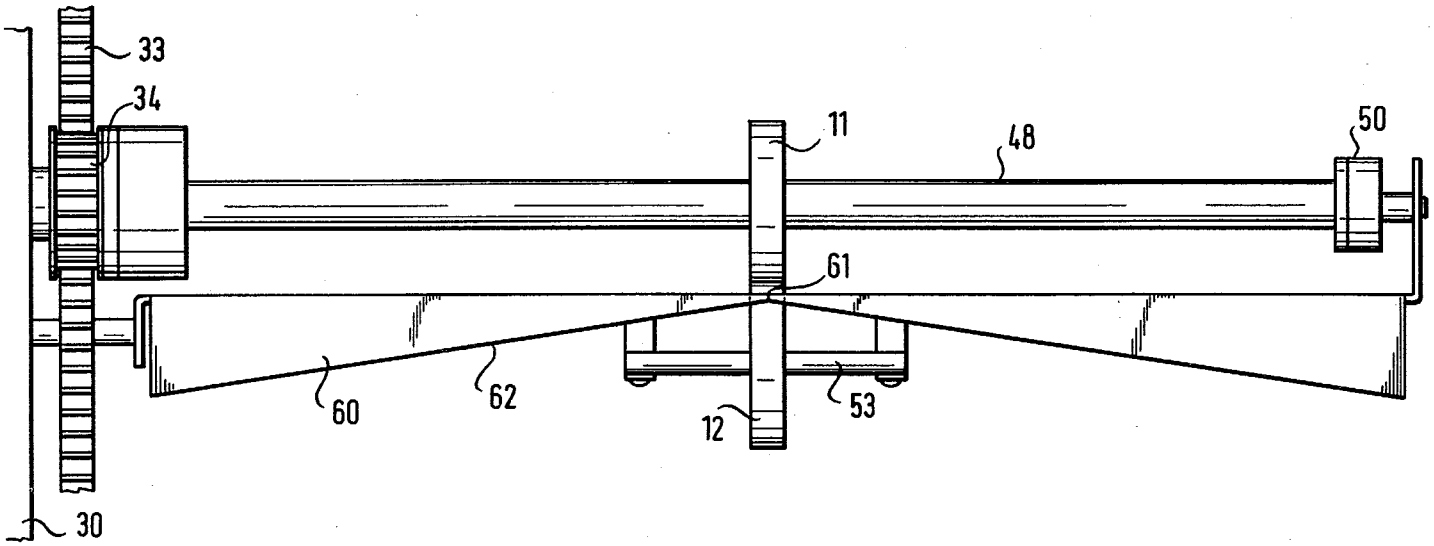
FIG. 5 is a front view of the feed roller pair of a separating device according to the lines IV—IV of FIG. 3.

To achieve smaller tearing forces in the form separators and to reduce the sizes of the structural parts, it is provided that the respective continuous paper strip layer 9, 9', 9'' or 9''' extend at an angle from the feed roller pair 11, 12 toward the outlet roller pair 16, 17. The strip part which extends toward the outlet roller pair 16, 17 is thereby bent at an angle of approximately 35° with respect to the strip part which extends out of the feed roller pair 11, 12. A tearing aid 18 exists at a bending point in the form of a tearing plate 60, which can be seen in FIG. 5. This tearing plate 60 has a roof-shaped design. The tearing point 61 is in the center of the strip. From this point 61 extends the tearing plate toward both sides, transversely of the strip and sloped upwardly. Viewed in the longitudinal direction of the strip, the tearing plate 60 starts, facing the feed rollers 11, 12, in a horizontal plane, from which the ridge passes over into the point 61. At both sides of the center ridge with the point 61 at the end, the tearing plate falls off slopingly at both sides. The tearing plate forms a tearing edge 62 at the outlet end. The form of this tearing edge 62 can clearly be seen from FIG. 5. The paper strip layer is bent over this tearing edge 62 and is separated during the tearing operation. Due to the special shape of the tearing edge 62, the tearing operation starts in the area of the point 61 in the center of the web and it continues from this point 61 toward both sides transversely of the paper strip in the area of the perforation of the same. This special tearing aid considerably reduces the necessary tearing force for separating the paper strip in the area of the transverse perforation.

To permit an alignment of the paper strip layer which must be separated in a simple manner by means of a not-shown longitudinal guide, at least one of the feed rollers 11, 12, preferably both, are constructed in the form of narrow rubber wheels, preferably only 10 mm. wide. This makes it possible that the continuous strip layer which must be separated can move slightly laterally between the feed rollers 11, 12, in order to align to a longitudinal guide.

The outlet rollers 16, 17 can also in a similar manner be built of several side-by-side spaced-apart arranged disk-shaped rubber wheels.

In order that the transverse perforation of each continuous web is at the start of the tearing operation above the tearing edge 62 of the tearing plate 60, the outlet roller pair 16, 17 can be adjusted with respect to the feed roller pair 11, 12 in longitudinal direction of the web. The contact line of the outlet rollers 16, 17 must thereby be spaced at a distance L from the tearing edge 62 of the tearing plate 60, as can be seen from FIG. 1, whereby the length L must correspond to the paper strip layer sheet which must be separated.

Since as a rule one writing set is to be separated from the continuous strip 1, namely all strip layer sheets which are to be separated and are associated with one another and have the same length, the outlet rollers 16, 17 of the form separators 13, 13', 13'' and 13''' are arranged one above the other in a common adjustable frame 70. The frame 70 is hinged at each of its upper and lower ends to a rocker arm 71, 72, which with their other ends are hinged to the frame 30. At least one of the rocker arms 71, 72 can be secured in its position. When the rocker arms 71, 72 are released, the frame 70 is guided with respect to the frame 30 in a parallelogram fashion. The contact lines of the outlet rollers 16, 17 move thereby on an arc, the radius of which is, however, considerable, so that a small change in the elevational position of these lines, which change occurs during adjustment, is insignificant.

In order to be able to store different lengths of individual sheets in the storage compartments 20, 20', 20'' and 20''' in stacks without difficulties, each storage compartment can be adjusted to the desired sheet size. For this purpose, it is for example possible to adjust and secure the backwall 73 in the direction of the arrow as shown.

As can be seen from FIG. 2, the outlet rollers are driven in the adjustable frame 70 in a similar manner as the inlet feed rollers 11, 12. The frame 70 has for this purpose a drive motor 75 with a pinion 76. A toothed belt 77 extends over the gears 79 of the driven outlet rollers 16, 16', 16'' and 16'''. Guide wheels 78 assure that the toothed belt for the gears 78 which must be driven assumes the corresponding looping angle and that it is constantly tensioned.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A device for separating a continuous, transversely perforated multi-layered strip into individual strips, comprising:

a base frame; and a plurality of strip handling means mounted on said base frame for processing said multi-layered strip, each of said strip handling means including (1) a separator device for separating an individual continuous and transversely perforated strip from said multi-layered strip, (2) form bursting means for effecting a severing of said individual continuous strip into individual sheets subsequent to passing through said separator device, and (3) storage means for storing said individual sheets therein.

2. The device according to claim 1, wherein said plurality of strip handling means are vertically aligned on said base frame.

3. The device according to claim 1, wherein each of said plurality of strip separator handling means further includes a carbon paper wind-up device for winding up carbon paper layers between the individual layers of said multi-layered strip.

4. The device according to claim 3, including common drive means on said base frame for driving said plural separator devices and said carbon paper wind-up devices.

5. A device for separating a continuous, transversely perforated multi-layered strip into individual strips, comprising:

a base frame; and a plurality of strip handling means mounted on said base frame for processing said multi-layered strip, each of said strip handling means including (1) a separator device for separating an individual continuous and transversely perforated strip from said multi-layered strip, (2) form bursting means for effecting a severing of said individual continuous strip into individual sheets, (3) storage means for storing said individual sheets therein, and (4) a carbon-paper wind-up device for winding up carbon-paper layers between the individual layers of said multi-layered strip;

each of said form bursting means on said base frame including an inlet roller pair and an outlet roller pair, said outlet roller pair being driven at a greater peripheral speed than said inlet roller pair, a roof-shaped tearing edge arranged between said inlet and said outlet roller pairs over which said single continuous strip passes, the speed differential of said inlet and said outlet roller pairs rendering said strip taut as said transverse perforations pass over said tearing edge and effecting a severing of said strip into said individual sheets.

6. The device according to claim 5, wherein at least one roller of at least one of said inlet and said outlet roller pair is constructed as a narrow rubber wheel.

7. The device according to claim 5, wherein said outlet roller pairs of each separator device are arranged one above the other on an adjustable frame and includes adjusting means for adjusting the position of said adjustable frame with respect to said base frame.

8. The device according to claim 7, wherein said adjustable frame is connected to said base frame through securable parallel guide rods.

9. The device according to claim 7, wherein said storage means includes compartments connected to and movable with said adjustable frame and are arranged adjacent said outlet roller pairs.

10. The device according to claim 9, including common drive means for driving said outlet roller pair arranged on said adjustable frame.

11. The device according to claim 5, wherein each inlet roller of said plural separator devices and each wind-up device is driven through a slip clutch.

12. The device according to claim 11, wherein each inlet roller pair includes a first shaft supporting one of said inlet rollers and a gear mounted on a second shaft and operatively connected to said first shaft through said slip clutch for facilitating the movement of said single strip and a freewheeling device located between said gear and said second shaft for limiting the speed of rotation of said second shaft so that it can never exceed the speed of rotation of said gear thereby rendering said slip clutch ineffective during a severing operation when the paper pull accelerates said second shaft.

* * * * *